US006910404B2

(12) United States Patent
Wolff et al.

(10) Patent No.: US 6,910,404 B2
(45) Date of Patent: Jun. 28, 2005

(54) GUN BOLT LOCKING MECHANISM

(75) Inventors: Peter C. Wolff, Georgia, VT (US); Peter A. Bates, Underhill, VT (US)

(73) Assignee: General Dynamics Armament and Technical Products, Inc., Falls Church, VA (US)

( * ) Notice: Subject to any disclaimer, the term of this patent is extended or adjusted under 35 U.S.C. 154(b) by 0 days.

(21) Appl. No.: 10/436,238

(22) Filed: May 13, 2003

(65) Prior Publication Data

US 2005/0011346 A1 Jan. 20, 2005

(51) Int. Cl.[7] ..... F41F 1/10
(52) U.S. Cl. ..... 89/12; 89/180
(58) Field of Search ..... 42/70.08; 89/9, 89/11, 12, 13.05, 180, 188, 190

(56) References Cited

U.S. PATENT DOCUMENTS 2,811,902 A * 11/1957 Dixon ..... 89/165
3,690,215 A * 9/1972 Clark et al. ..... 89/12
3,766,821 A * 10/1973 Cozzy et al. ..... 89/12
4,065,998 A * 1/1978 Rocha ..... 89/11
4,141,276 A * 2/1979 Taylor et al. ..... 89/11
4,154,142 A * 5/1979 Schwegler ..... 89/11
4,172,410 A * 10/1979 Reynolds et al. ..... 89/188
4,550,641 A * 11/1985 Bruderer et al. ..... 89/12

* cited by examiner

*Primary Examiner*—Michael J. Carone
*Assistant Examiner*—Gabriel S. Sukman
(74) *Attorney, Agent, or Firm*—Hunton & Williams

(57) ABSTRACT

A carrier assembly for a gun comprises a gun bolt carrier disposed to reciprocate axially with respect to the central axis of the gun, and a gun bolt disposed to reciprocate axially within the carrier. The gun bolt has a locking groove therein. The assembly also comprises a bolt locking mechanism extending through a portion of the bolt carrier to selectively engage the locking groove and thereby prevent the bolt from moving with respect to the carrier. The assembly further comprises a generally axial groove in a non-reciprocating portion of the gun that engages and selectively rotates the rotatable bolt locking mechanism to selectively lock the bolt to the carrier.

29 Claims, 15 Drawing Sheets

GUN BOLT LOCKING MECHANISM

This invention was made with Government support under contract DAAH23-00-C-A001 awarded by the U.S. Army Aviation & Missile Command. The Government has certain rights in this invention.

BACKGROUND OF THE INVENTION

The present invention relates to a gun bolt locking mechanism. More particularly, the present invention relates to a device and method for locking a bolt to a bolt carrier during certain stages of the cycle of operation of a self-loading gun. It finds particular utility in a fully automatic gun and especially in a rotary, multi-barreled, machine gun.

The operation of self-loading, single-barreled guns is well known. Whether in semi-automatic or full automatic operation, the rate of fire is limited by the speed at which the gun can load, fire, and eject the spent cartridge of the ammunition being fired. Most of such weapons use the energy associated with the expanding gas or resulting recoil to operate the gun. Rotary machine guns are weapons that are designed to fire ammunition at an extremely high rate when compared to other types of weapons. A rotary machine gun includes a series of barrels that are mounted on a rotor assembly. The rotor assembly is externally driven, that is, power is applied to the rotor to rotate it with respect to a stationary gun housing to load, fire, and eject the spent casing as ammunition is fired in each barrel in rapid succession. As ammunition is fired in one barrel, a round is being loaded into another barrel, while a spent casing is extracted from yet another barrel. In this manner, the rotary machine gun achieves the high rate of fire.

Each round of ammunition is fired by igniting a primer contained within the cartridge case. There are two commonly used methods of igniting the primer. Some guns use electrical energy to ignite the primer, while other guns use mechanical force applied to the primer, normally by a firing pin. Accordingly, there are also two types of ammunition: electrically primed and percussion primed. Electrically primed ammunition must be fired with electrical energy and percussion primed ammunition must be fired with a mechanical impact.

Certain rotary machine guns manufactured by General Dynamics Armament and Technical Products are commonly used as part of the weapons systems on fighter aircraft. It has been discovered that under certain conditions, radiation generated by radar and communications equipment can ignite electrically primed ammunition. When these conditions occur, the uncontrolled ignition of the 20-mm shells creates a serious safety hazard. To eliminate this safety hazard, the aircraft should be able to switch from electrically-primed ammunition to percussion-primed ammunition with little or no modification to the gun.

In certain rotary machine guns having a reciprocating bolt associated with a reciprocating bolt carrier, a means is required to lock the gun bolt in an extended position relative to the bolt carrier during most of the gun cycle (cartridge extract, eject, rear dwell, cartridge feed, and cartridge ram), and to release the extended bolt during the rest of the gun cycle (bolt locking, firing, and unlocking).

With a rotary machine gun that only fires electrically-primed ammunition, the bolt locking mechanism can pass directly through the bolt body. For a firing mechanism that will work with both electric- and percussion-primed ammunition, however, the bolt locking mechanism cannot pass through the bolt body due to the need for a centrally-located firing pin and its spring mechanism.

SUMMARY OF THE INVENTION

The present invention is directed to a device and method for locking a bolt to a bolt carrier. While not limited to rotary, multiple-barreled machine guns, the preferred embodiment allows such a gun to fire both electric- or percussion-primed ammunition.

In accordance with one aspect, the present invention is directed to a carrier assembly for a gun. The assembly comprises a gun bolt carrier disposed to reciprocate axially with respect to the central axis of the gun, and a gun bolt disposed to reciprocate axially and rotate within the carrier. The gun bolt has a locking groove therein. The assembly also comprises a bolt locking mechanism extending through a portion of the bolt carrier to selectively engage the locking groove and thereby prevent the bolt from moving with respect to the carrier. The assembly further comprises a generally axial groove in a non-reciprocating portion of the gun that engages and selectively rotates the rotatable bolt locking mechanism to selectively lock the bolt to the carrier.

In accordance with another aspect, the present invention is directed to a multi-barreled machine gun having an externally powered rotor including a carrier assembly that reciprocates along the longitudinal axis of the rotor. The carrier assembly includes a bolt carrier having a gun bolt reciprocally mounted therein. The gun bolt includes a locking groove. The carrier assembly also includes a bolt locking mechanism for selectively locking the bolt to the carrier such that the machine gun is capable of firing both electric and percussion primed ammunition. The bolt locking mechanism comprises a selectively rotatable locking member extending through a portion of the bolt carrier to selectively engage the locking groove and thereby prevent the bolt from reciprocating axially within the carrier. The carrier assembly includes an axial groove in a non-reciprocating portion of the gun that engages and selectively rotates the selectively rotatable locking member to selectively lock the bolt to the carrier.

In accordance with another aspect, the present invention is directed to a method for selectively locking a gun bolt to a bolt carrier in a self-loading gun, including providing a gun bolt locking mechanism in the bolt carrier. The locking mechanism has a crank and crank pin at one end thereof. The crank pin engages a groove in a stationary portion of a gun. The groove is disposed to rotate the locking mechanism when the bolt carrier moves axially within the gun. The locking mechanism includes a bolt locking portion for engaging the bolt. The method also includes timing the rotation of the locking mechanism so that the bolt is locked to the bolt carrier during specific portions of the movement of the bolt.

In yet another aspect, the present invention is directed to the method recited above for a multi-barreled machine gun.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate an embodiment of the present invention and together with the description, serve to explain the principles of the invention.

DESCRIPTION OF THE EMBODIMENTS

Reference will now be made in detail to embodiments of the invention, an example of which is illustrated in the accompanying drawings. Wherever possible, the same reference numbers will be used throughout the drawings to refer to the same or like parts.

In accordance with the invention there is provided a carrier assembly for a gun. The carrier assembly comprises a gun bolt carrier disposed to reciprocate axially with respect to the central axis of the gun, and a gun bolt disposed to reciprocate axially within the carrier.

Figure 1:
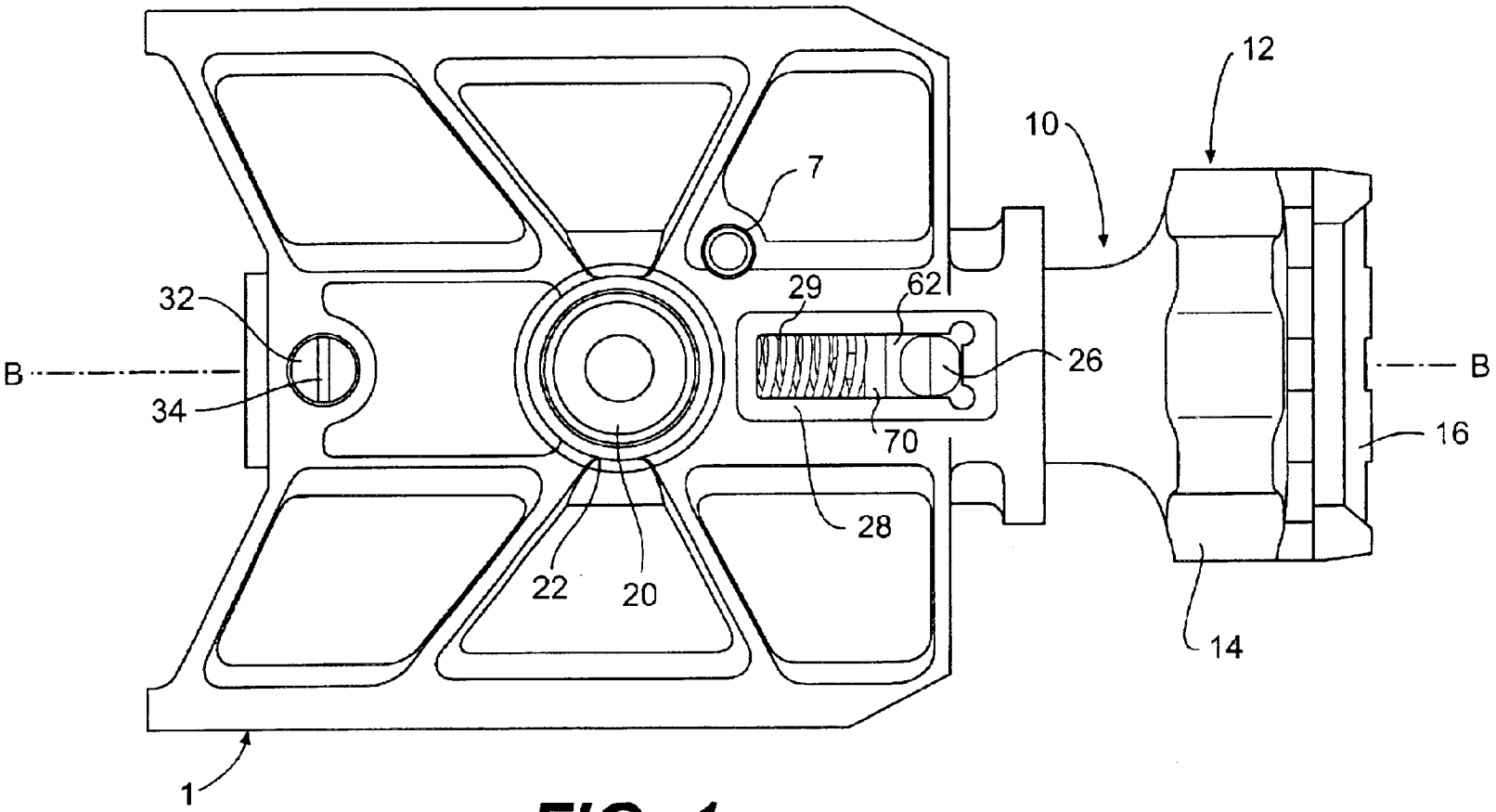
FIG. 1 is a top view of an embodiment of the invention, with the bolt in an extended position.
Figure 2:
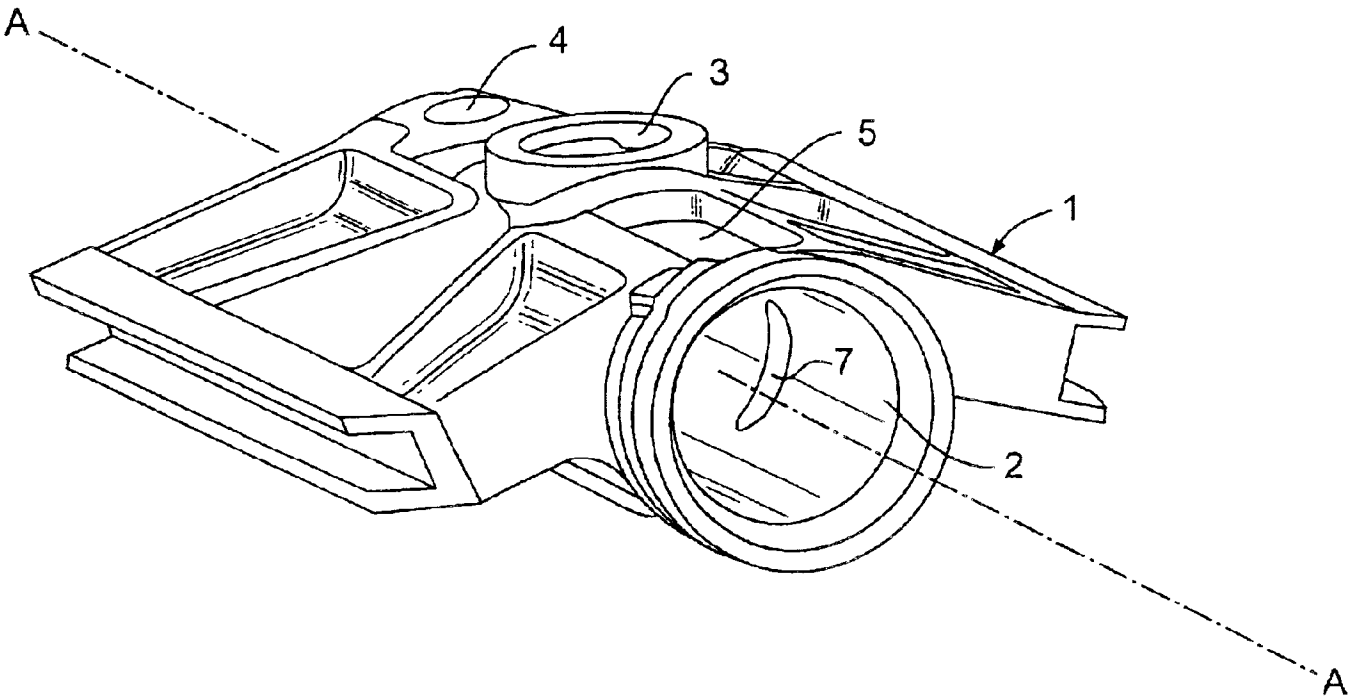
FIG. 2 is a front perspective view of the bolt carrier of FIG. 1 (without the bolt)
Figure 3:
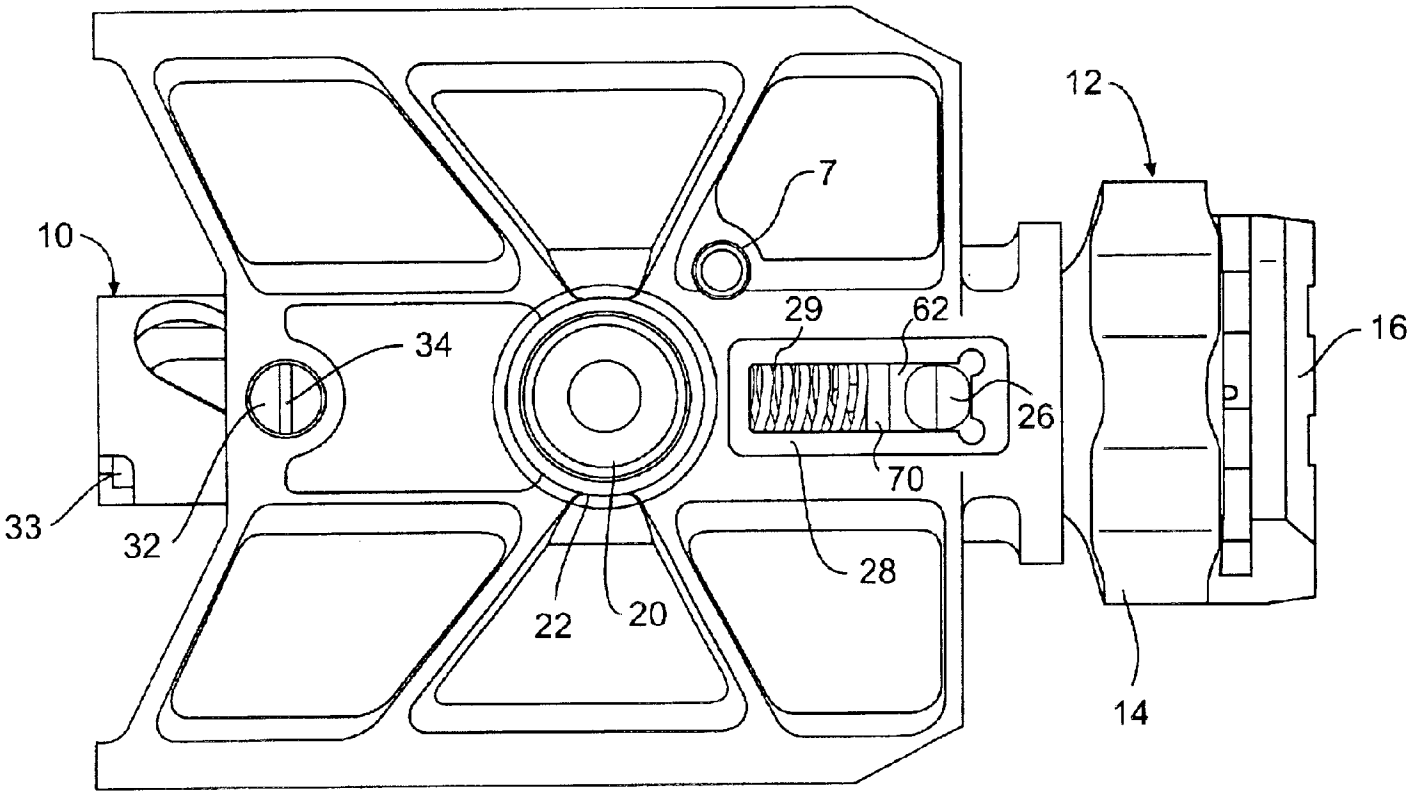
FIG. 3 is a top view of the embodiment of FIG. 1, with the bolt in a retracted position.

As here embodied, and depicted in FIG. 1, the carrier assembly includes a bolt carrier 1 which houses a gun bolt 10. As depicted in FIG. 2, the bolt carrier 1 includes a cylindrical opening 2 that is oriented along the central longitudinal axis A—A of the carrier 1. The gun bolt 10 is mounted within the opening 2 in the bolt carrier 1 and reciprocates and rotates along the central axis A—A of the carrier 1 from an extended position shown in FIG. 1 to a retracted position as shown in FIG. 3. This embodiment is a multi-barreled, fully automatic machine gun. In such an embodiment the carrier 1 reciprocates parallel (or nearly so) to the central axis of the gun as the carrier 1 is rotated within a fixed housing (not shown) having interior cam surfaces (not shown) that interface with the carrier 1 and cause the reciprocating action of the carrier. This is the conventional manner of operation such a gun, and such operation is disclosed in U.S. Pat. No. 3,595,128 to Hoyt, Jr. which is incorporated by reference herein. The present invention, however, is not limited to this embodiment. The carrier assembly of the present invention could be a bolt assembly in a rifle or pistol that reciprocates by any means, such as by recoil, blowback, gas operation, or by manual manipulation of the carrier assembly.

Figures 6, 6A:
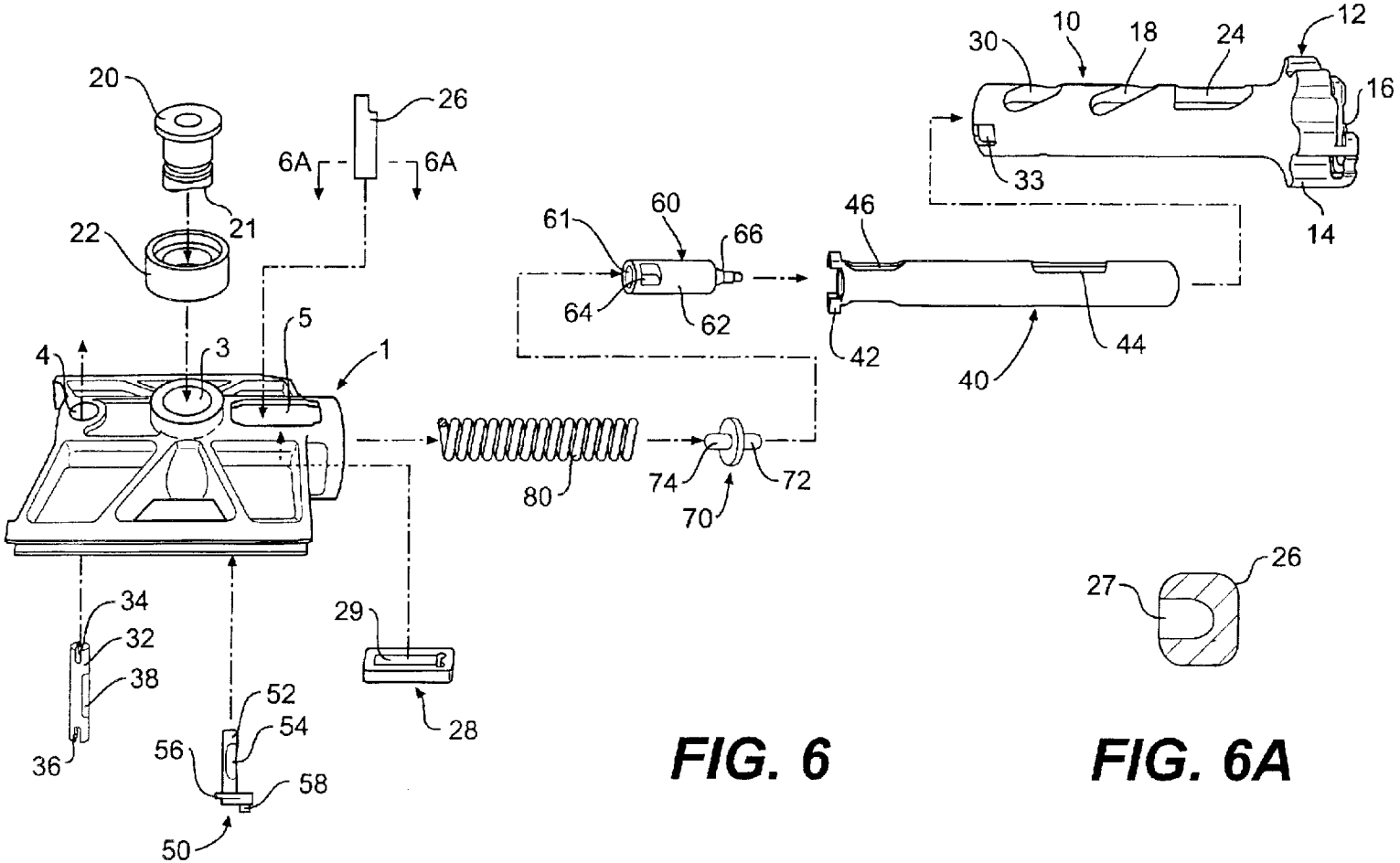
FIG. 6 is an exploded view of the embodiment of FIG. 1.
FIG. 6A is a cross-sectional view along lines 6A—6A of the cocking pin of FIG. 6.

As here embodied, and shown in FIGS. 1 and 2, the carrier 1 includes a central cam shaft bore 3 for receiving a cam shaft 20 that is surrounded by a cam roller 22. The cam roller 22 engages the camming surfaces (not shown) in the surrounding housing (not shown) to reciprocate the carrier assembly parallel (or nearly so) to the central axis of the gun. To facilitate assembly, the cam shaft 20 can be inserted into the bore 3 along the bore axis, and when the cam shaft is appropriately located in the bore 3 it is detachably affixed to the carrier 1 such that it cannot move axially within the bore 3. As shown in FIG. 6, in this embodiment the cam shaft 20 is allowed to rotate because, at the extremity of the cam shaft 20, there is a camming surface 21 that engages a camming slot 18 in the bolt 10. When the bolt 10 is not locked to the carrier 1, movement of the carrier axially within the gun rotates the bolt 10 by the action of the camming surface 21 on the camming slot 18. The amount of axial movement of the bolt 10 within the carrier 1 is determined by the length of the camming slot 18 and the angle of the camming slot 18 to the central axis A—A of the carrier 1 and bolt 10. The amount of rotation of the bolt 10 within the carrier 1 is determined by the length of the camming surface 21 and the radial extent of the camming slot 18. The bolt 10 is rotated in order to engage and disengage the locking lugs 14 on the face 12 of the bolt 10 from the locking lugs 102 (see FIG. 10) in the barrel of the gun. Thus, the angle of bolt rotation is determined by the amount of rotation needed to lock and unlock the bolt from the barrel or chamber of the gun.

In accordance with the invention, the bolt in the carrier assembly includes a locking groove therein. As here embodied, and most clearly depicted in FIGS. 4 and 5 the bolt 10 includes a locking groove 19 in the exterior surface of the bolt 10 that is transverse to the longitudinal axis B—B of the bolt 10. While the embodiment depicted has a single locking groove in the bolt, more that one such groove can be used. As will be apparent from the disclosure below, the locking groove(s) in the bolt are to interface with components that lock the bolt to the bolt carrier.

In accordance with the invention the carrier assembly further includes a bolt locking mechanism extending through a portion of the bolt carrier to selectively engage the locking groove and thereby prevent the bolt from reciprocating axially within the carrier. Preferably, the bolt locking mechanism comprises an elongated shaft having a bolt passage groove therein, the bolt passage groove having a shape that allows the bolt to pass through the bolt passage groove.

Figure 4:
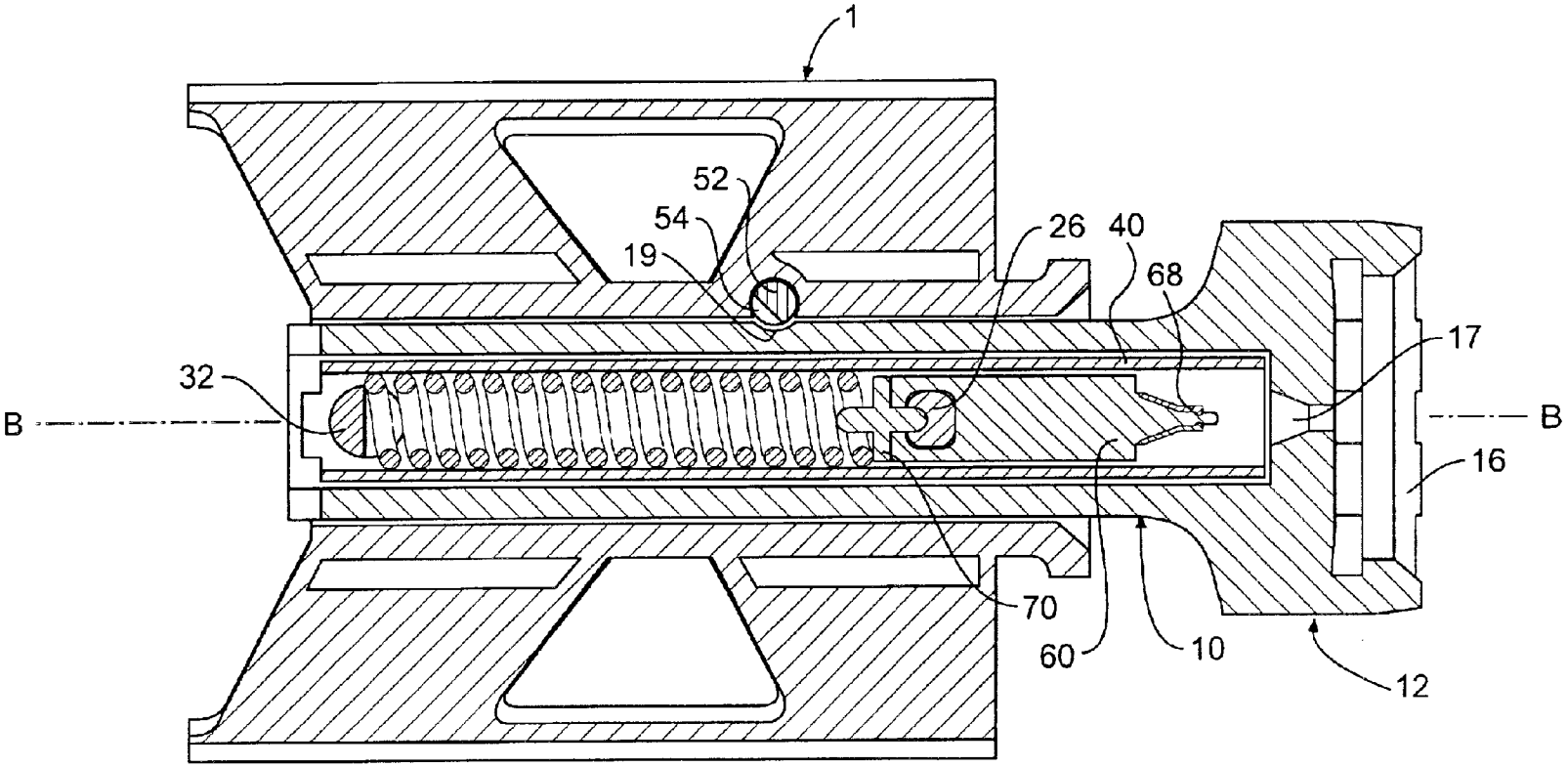
FIG. 4 is a cross-sectional view of FIG. 1, with the bolt in an extended position and the bolt locking mechanism in a locked position.
Figure 5:
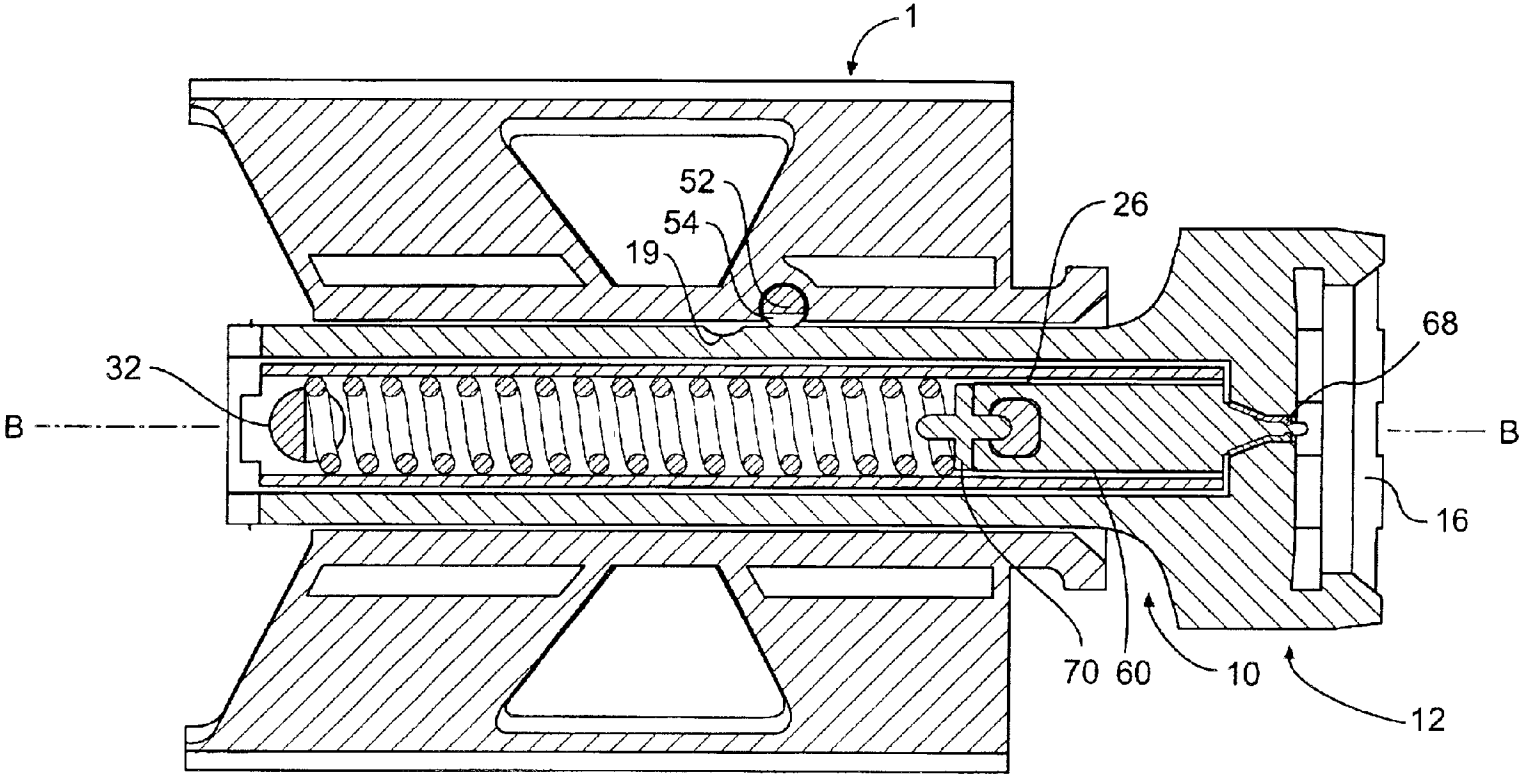
FIG. 5 is a cross-sectional view of FIG. 3, with the bolt in a retracted position and the bolt locking mechanism in an unlocked position.
Figure 7B:
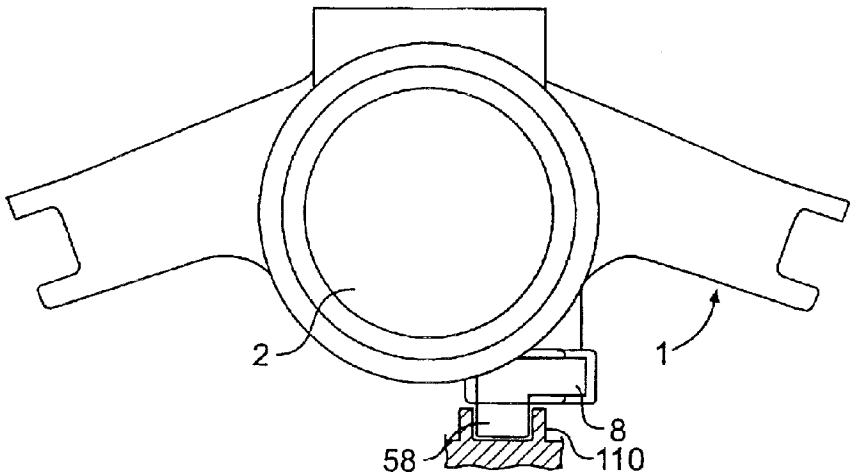
FIG. 7B is a front view of the bolt carrier and bolt locking mechanism of FIG. 1 (without the bolt), with the bolt locking mechanism in an unlocked position.
Figure 7A:
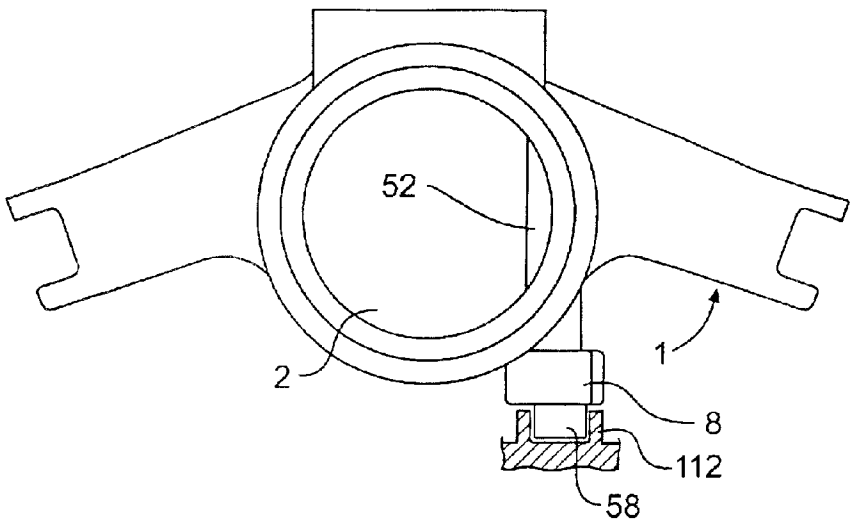
FIG. 7A is a front view of the bolt carrier and bolt locking mechanism of FIG. 1 (without the bolt), with the bolt locking mechanism in a locked position.

As here embodied, and shown in FIG. 6, the carrier assembly includes a locking shaft 50, that operates the bolt locking mechanism, with the locking shaft 50 having a bolt passage groove 54 therein. The locking shaft 50 further includes a shaft body 52, a crank 56 and a crank pin 58. As will be disclosed below, the crank 56 and the crank pin 58 operate with other portions of the gun to selectively rotate the locking shaft 50. As shown in FIG. 6, the preferred embodiment of the invention has a bolt 10 that has a cylindrical outer surface, except for the face of the bolt having the locking lugs 12. The cylindrical portion of the bolt 10 fits within the axial bore 2 of the carrier 1, as depicted in FIGS. 4 and 5. In such an embodiment, the bolt passage groove 54 of the locking shaft 50 is semi-circular with a radius substantially equal to the radius of the cylindrical bolt. As here embodied, and depicted most clearly in FIGS. 4, 5, 7A and 7B, rotation of the shaft 50 causes the bolt passage groove 54 to align with the sidewalls of the bore 2 in the configuration of FIG. 7B such that the bolt 10 may move axially (along axis A—A) within the bore 2, or the shaft 50 can be rotated such that the shaft body 52 protrudes from the sidewall of the bore 2 to engage the locking groove 19 in the bolt 10. FIGS. 4 and 5 show the effect of the rotation of the locking shaft 50 on the locking of the bolt 10. In FIG. 4 the shaft body 52 is engaged with the locking groove 19 such that the bolt 10 cannot move axially within the bore 2 of the carrier 1. In FIG. 5 the shaft 50 has been rotated 45° such that the bolt passage groove 54 allows the bolt 10 to move axially within the bore 2 of the carrier 10.

In accordance with the invention, the carrier assembly further includes a generally axial groove in a non-reciprocating portion of the gun that engages and selectively rotates the bolt locking mechanism to selectively lock the bolt to the carrier. By "generally axial" it is meant that the groove has its longitudinal axis generally aligned with the direction of linear movement of the carrier within the gun, but as will be disclosed in detail below, at least a portion of the groove is displaced with respect to the linear motion of the carrier to rotate the bolt locking mechanism.

Figure 8:
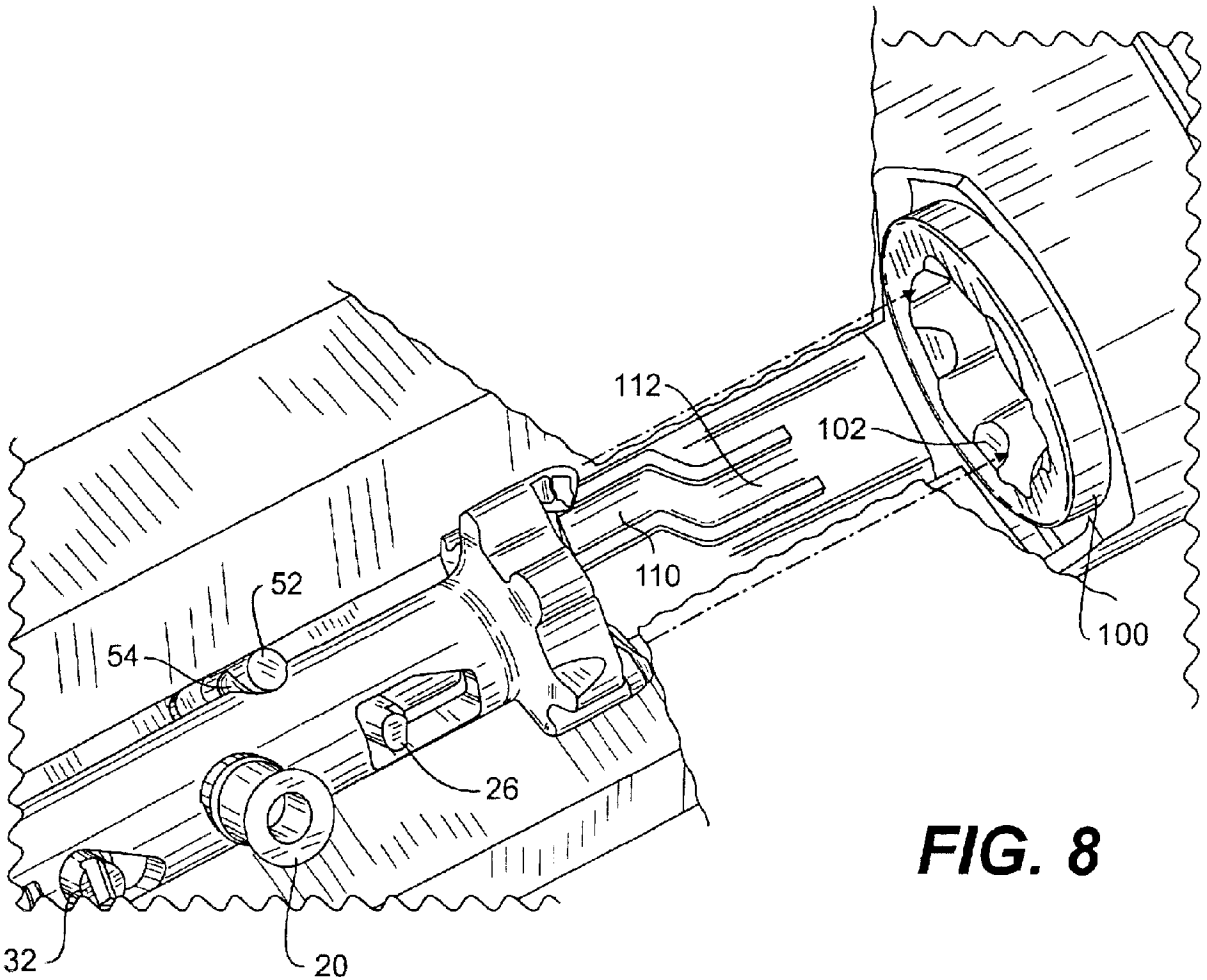
FIG. 8 is a view of the gun bolt of the embodiment of FIG. 1 illustrating the gun bolt's placement in a rotor of a rotary machine gun.

As here embodied, and disclosed above, the locking shaft 50 further includes a crank 56 and a crank pin 58. The crank pin 58 is offset from the axis of rotation of the locking shaft 50 such that movement of the crank pin 58 in a direction at an angle to the direction of the linear (reciprocating) motion of the carrier will rotate the locking shaft 50. FIG. 8 depicts an embodiment of the present invention where the non-reciprocating portion of the gun beneath the carrier 1 includes a groove 110 that is generally aligned with the direction of motion of the carrier 10. The groove 110, however, includes a displaced portion 112 that is displaced laterally with respect to the direction of reciprocating motion of the carrier 1. In this embodiment, the crank pin 58 is placed within the groove 110 such that the reciprocating motion of the carrier along its linear axis causes the crank pin to move laterally with respect to the motion of the carrier such that the locking shaft 50 is rotated. The location of the displaced portion 112 of the groove 110 along the linear axis of the carrier 1 (and its direction of motion) is used to time the locking and unlocking of the bolt 10 to the carrier. What is meant by the "timing" of the locking and unlocking is the occurrence of locking and unlocking with respect to the cyclic operation of the gun. Because the location of the carrier along its linear path corresponds to certain operations of the gun, the location of the displaced portion 112 in the groove 110 along that linear direction causes the bolt to be locked and unlocked at specific positions during that cyclic operation.

The bolt 10 is locked in its extended position during the bolt cartridge extract, eject, rear dwell, cartridge feed, and cartridge ram stages of the gun cycle. It is only when the bolt locking mechanism 50 is rotated to release the bolt 10 that the bolt 10 can translate relative to the carrier 1 to its retracted position. The bolt 10 is released by the bolt locking mechanism 50 during the bolt locking, firing, and unlocking stages of the gun cycle.

Preferably, the bolt locking mechanism of the present invention includes a locking portion that engages the bolt carrier to prevent axial movement of the bolt locking mechanism. "Axial movement" of the bolt locking mechanism, means in a direction parallel to the length of the shaft body 52. As here embodied, and depicted in FIGS. 9A and B, the locking shaft 50 includes a flange 56. As here embodied, the flange 56 comprises a radial segment of a circle. The flange 56 engages a portion of the bolt carrier 1 to prevent axial movement of the bolt locking shaft along its own axis. As here embodied, the bolt carrier 1 includes a circular groove 8 engaging the flange 56 to prevent axial movement of the locking shaft 50. As depicted in FIG. 10, the groove 8 is preferably a radial segment of a circle.

An exemplary embodiment of a carrier assembly is illustrated in the exploded view of FIG. 6. The bolt carrier 1 includes a forward opening 5 for a cocking pin 26 surrounded by an accompanying electrical insulator 28. The carrier further includes a rear opening 4 for an insulator/bolt assembly pin 32 to extend therethrough.

The non-cylindrical portion of the gun bolt 10 preferably includes a bolt head 12 with locking lugs 14 and a flange extractor 16 for spent shell removal. The gun bolt 10 further includes a camming groove 18 for the cam shaft 20, and a forward aperture 24 for the cocking pin 26. A rear aperture 30 in the gun bolt 10 allows the insulator/bolt assembly pin 32 to slide therethrough. The bolt 10 also includes apertures 33 on opposing sides of a rear end of the bolt that accommodate flanges 42 of a tubular electrical insulator 40.

The insulator 40 preferably includes a forward aperture 44 for the cocking pin 26 and a rear aperture 46 for the insulator/bolt assembly pin 32. The insulator 40 also includes flanges 42, and houses a firing pin 60, a detent pin 70, and a coil spring 80. The detent pin 70 has a forward pin 72 that interacts with the cocking pin 26 and a rear spring guide 74 that interacts with the firing pin spring 80.

Insulator/bolt assembly pin 32 is preferably a cylindrical shaft and may include identical grooves 34 an 36 on ends and a recess 38 along its length for receiving the end of the firing pin spring 80.

The cocking pin 26 includes a detent 27 into which the forward pin 72 can be inserted. The cocking pin insulator 28 includes a rectangular slot 29 within which the cocking pin 26 can slide from its cocked position to its fired position.

Figure 5A:
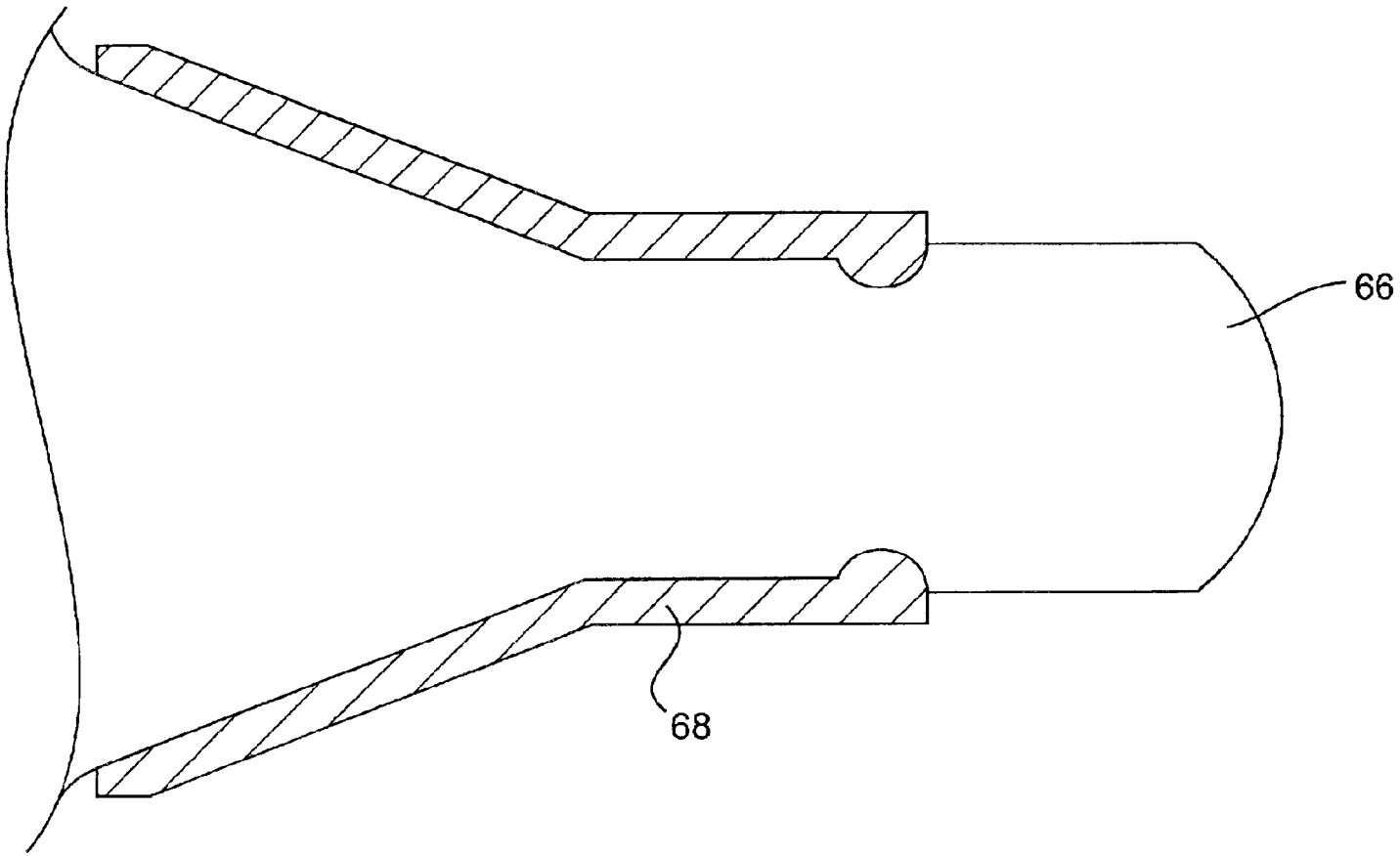

The firing pin 60 preferably includes an aperture 64 at the rear, into which the cocking pin 26 is inserted. The cocking pin 26 is retained in the aperture 64 by the front pin 72 of detent pin 70, that passes through the opening 61 in the rear of the firing pin 60 into the opening 27 of the cocking pin 26. At the front of the firing pin 60 is a firing tip 66 for detonating a percussion primer. As disclosed above, the preferred embodiment is also capable of firing electrically primed ammunition. The firing pin is electrically isolated from the carrier assembly by the tubular insulator 40, the insulator pin 32, the insulator 28, and a firing pin insulator 68 surrounding the tip 66 of the firing pin. As here embodied, and depicted in FIG. 5A, the firing pin has a frusto-conical sleeve 68 affixed mechanically by means of a rim and groove arrangement adjacent the end 66 of the firing pin 60. Thus an electrical current applied to the firing pin through the cocking pin 26 is not applied to the remainder of the bolt assembly.

In addition to providing electrical insulation to the firing pin 60, the firing pin insulator can be made of an electrically insulating material, such as a polymer. The resilience of such a material on the surface of the firing pin reduces or prevents damage to the firing pin and firing pin recess in the bolt face caused by "dry firing" the gun. Moreover, the life of the firing pin and bolt face are extended by the ready and periodic replacement of such a firing pin insulator.

One method of assembling the components of the preferred embodiment includes placing the firing pin 60 into the rear opening of the tubular insulator 40, and then the tubular insulator 40 is inserted into the bolt 10. Lugs 42, on opposing sides of the insulator 40 are inserted into apertures 33 on opposing sides of the bolt 10, and the insulator is turned within the bolt so that the flanges 42 of the insulator 40 engage grooves (not shown) on the inner bolt wall to lock the insulator 40 within the bolt 10. The insulator 40 is locked in the bolt 10 such that the forward apertures 24 and 44, and rear apertures 30 and 46, are substantially aligned. The insulator 28 is placed in the aperture 5.

The bolt 10 is inserted into the bolt carrier 1 through bore 2, so that the apertures 29, 24, and 44, the bore 3 and camming slot 18, and the rear apertures, 4, 30, and 46, are substantially aligned. The cocking pin 26 is inserted through the apertures 29, 24, 44, and 64 of the insulator, the bolt, the tubular insulator, and firing pin respectively.

Next, the detent pin 70 is inserted into the rear opening of the tubular insulator 40, now housed within the bolt 10 and the carrier 1, so that the forward pin 72 is inserted through the opening 61 in the back of the firing pin into the detent 27 in the cocking pin 26. The coil spring 80 is then inserted into the rear opening of the tubular insulator 40 so that the rear spring guide 74 extends into the firing pin spring 80. Next, the spring 80 is compressed and the insulator/bolt assembly pin 32 is inserted in the rear apertures 4, 30, 46, of the carrier, the bolt, and the tubular insulator, respectively, and rotated such that the firing pin spring 80 is seated in the recess 38 of the pin 32.

The cam shaft 20, surrounded by the cam roller 22 is inserted into the carrier bore 3 and camming groove 18, of the carrier and bolt, respectively. Preferably, the cam shaft 20 and the cam roller 22 are secured to the carrier 1 using a removable pin that simplifies assembly.

Figure 9:
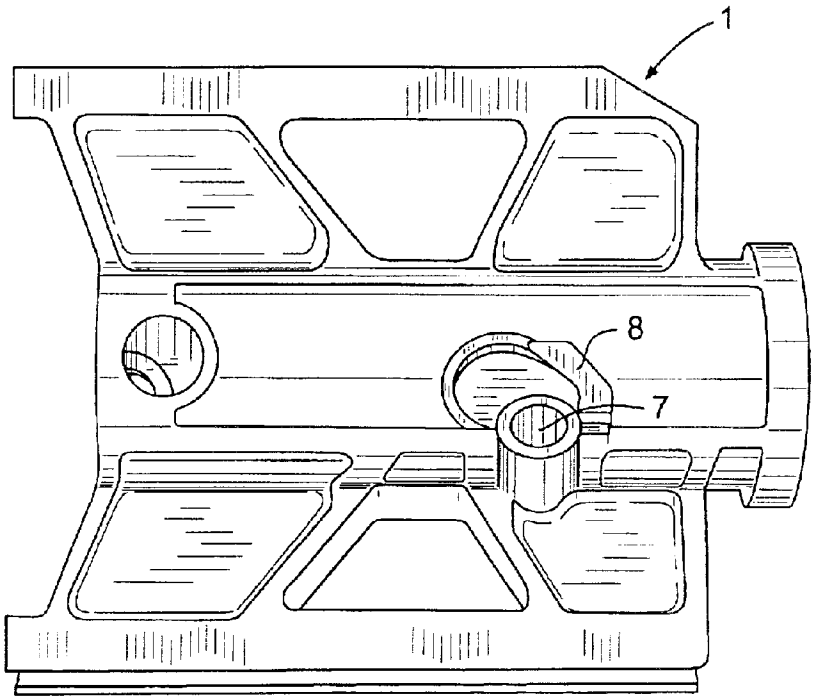
FIG. 9 is a bottom view of the bolt carrier of the embodiment of FIG. 1.
Figure 9B:
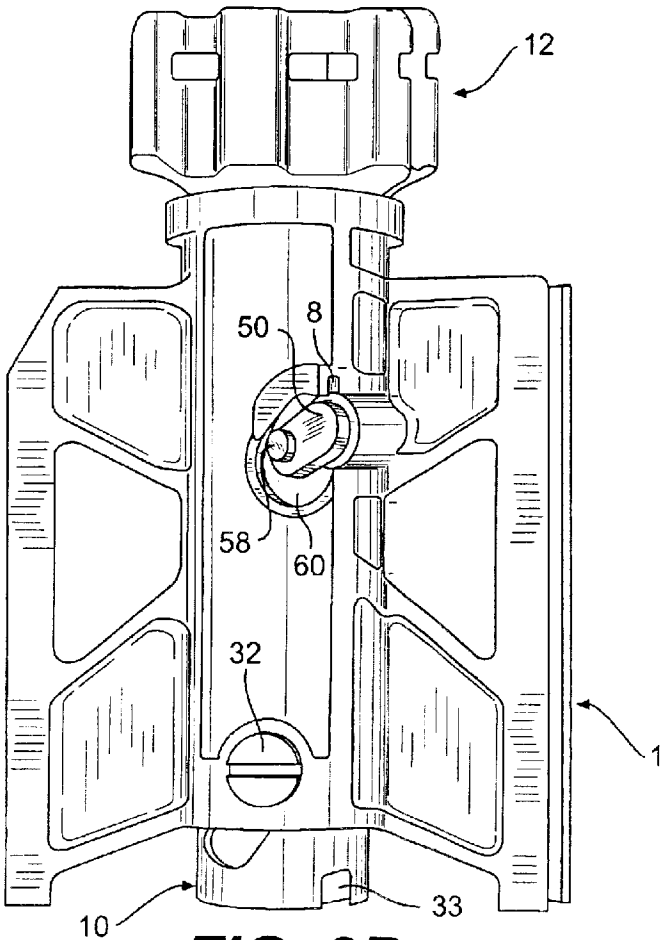
FIG. 9B is a bottom view of the embodiment of FIG. 1, with the bolt in a retracted position and the bolt locking mechanism in an unlocked position.
Figure 9A:
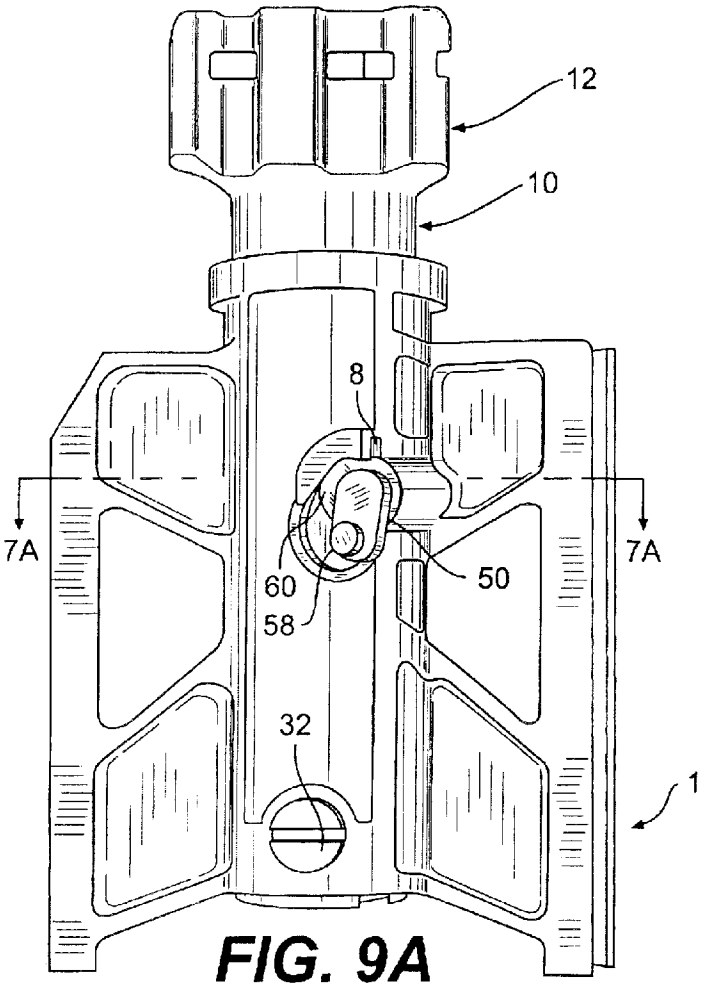
FIG. 9A is a bottom view of the embodiment of FIG. 1, with the bolt in an extended position and the bolt locking mechanism in a locked position.
Figure 10:
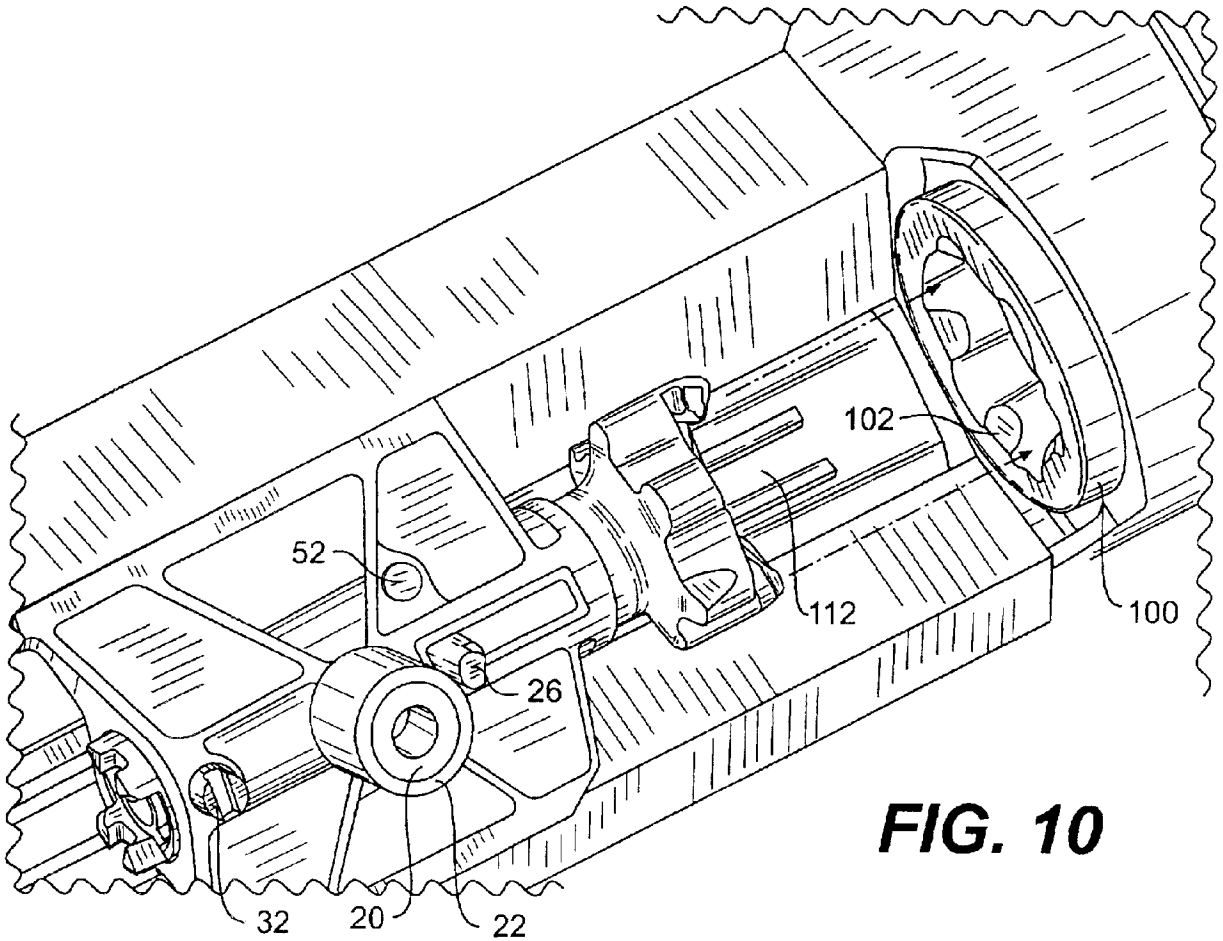
FIG. 10 is a view of the embodiment of FIG. 1 illustrating the embodiment's placement in a rotor of a rotary machine gun.
Figure 11:
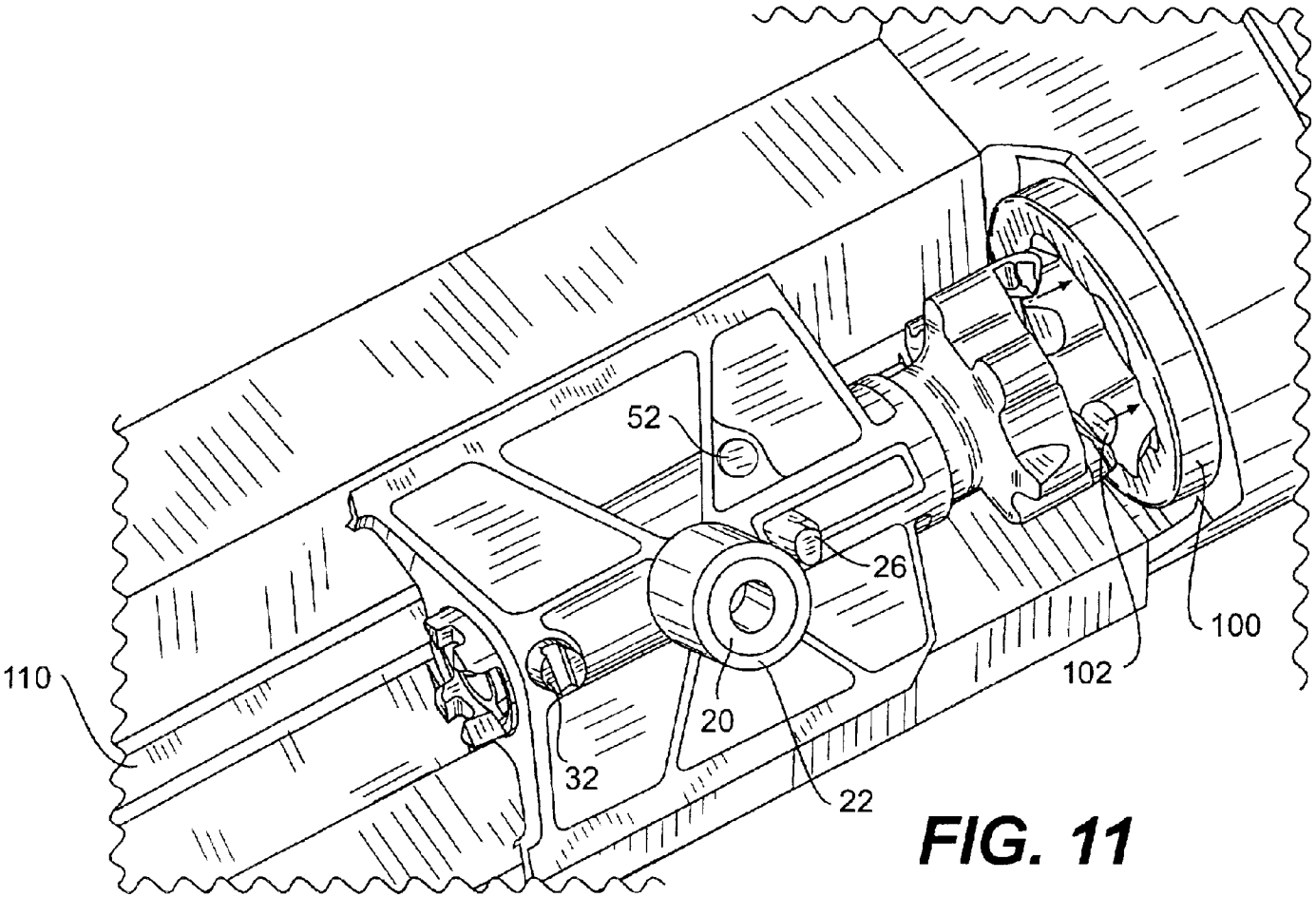
FIG. 11 is a view of the embodiment of FIG. 1 illustrating the gun bolt's placement in a rotor of a rotary machine gun.
Figure 12:
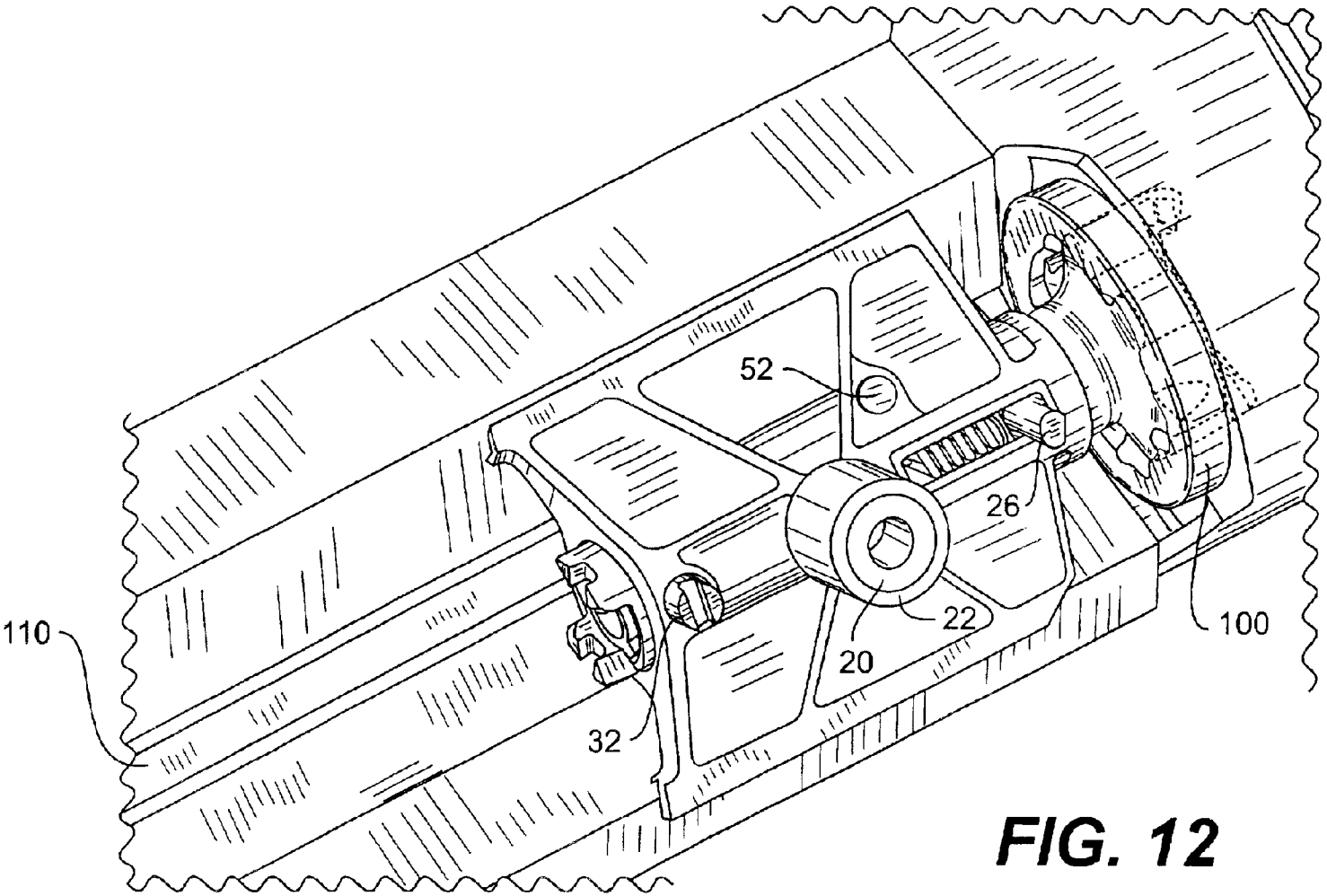
FIG. 12 is a view of the embodiment of FIG. 1 illustrating the gun bolt's placement in a rotor of a rotary machine gun.

As can best be seen in FIGS. 9A and 9B, after the carrier 1, the bolt 10, and the tubular insulator 40 have been assembled, the elongated shaft 52 of the bolt locking mechanism 50 is inserted into the bore 7 of the carrier 1. In order to successfully insert the elongated shaft 52 of the bolt locking mechanism 50 into the bore 7 of the carrier 1, the locking groove 19 of the gun bolt 10 must be substantially aligned with the bore 7 as depicted in FIG. 4. The shaft 52 is inserted into the bore 7 such that the flange 60 of the pin 50 rests adjacent to the circular groove 8 on the carrier 1. Once the shaft 52 is inserted all the way into the bore 7, the bolt locking mechanism 50 is rotated so that the flange 60 of the bolt locking mechanism rotates into the circular groove portion 8 of the carrier 1. This interaction of the circular groove portion 8 with the flange 60 retains the bolt locking mechanism 50 within the carrier 1 by restraining its movement in what is termed the axial direction, which, in this portion of the device, is along the axis of rotation of the shaft 52.

A rotary machine gun typically includes multiple carrier assemblies that reciprocate along tracks in a non-reciprocating rotor. As can be seen in FIGS. 10–14, the rotor rotates the tracks, the cam path in the surrounding housing (not shown) for the cam roller 22 guides the carrier assemblies axially in a known manner between (1) the bolt cartridge extract, eject, rear dwell, and cartridge feed stages of the gun cycle (see FIG. 11, cartridge not shown), and (2) the cartridge ram, bolt locking, firing, and unlocking stages of the gun cycle (see FIGS. 11–13, cartridge not shown).

Figure 13:
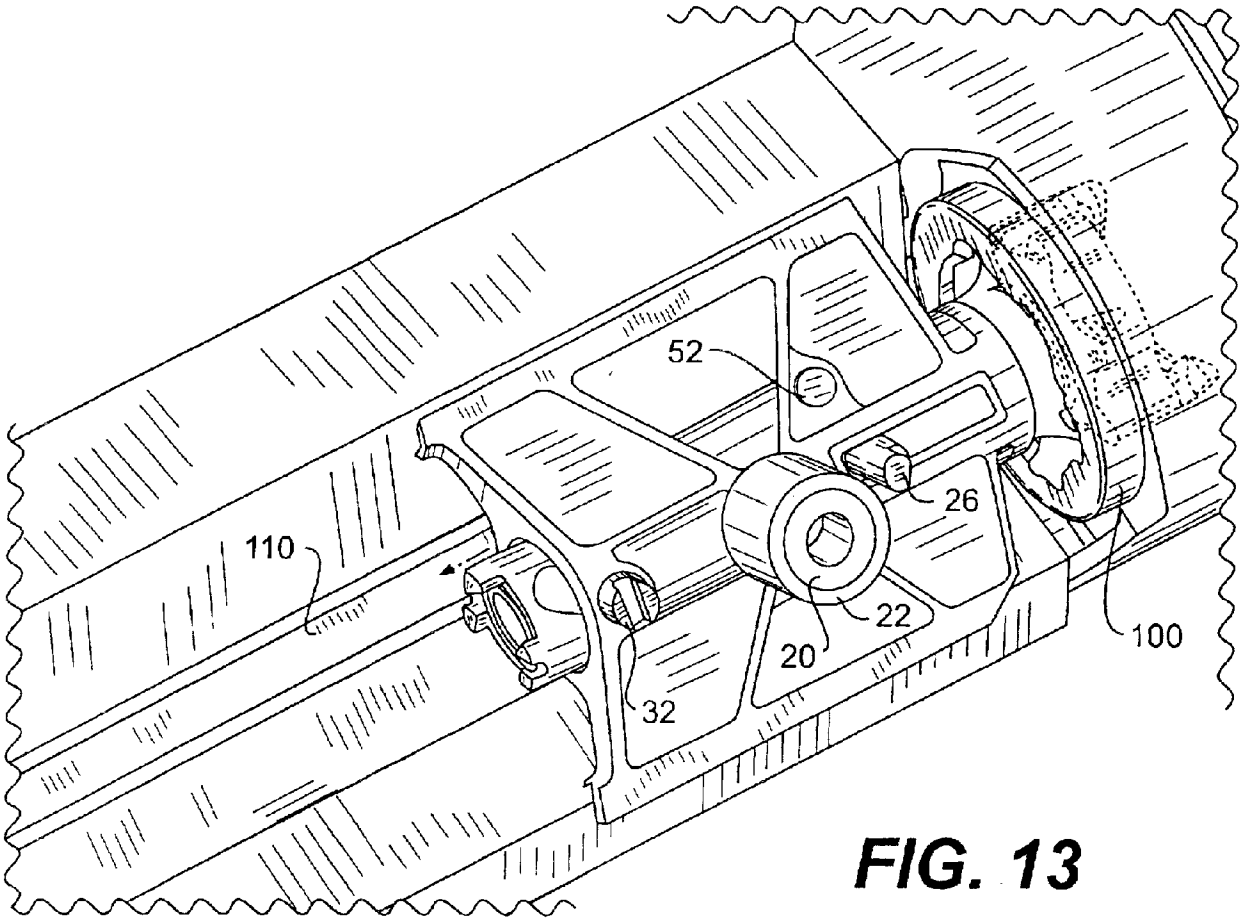
FIG. 13 is a view of the embodiment of FIG. 1 illustrating the gun bolt's placement in a rotor of a rotary machine gun.

Firing in a particular carrier 1 occurs after the bolt head 12 rotates after insertion into the firing chamber 100 such that the locking lugs 14 of the bolt head 12 engage locking lugs 102 of the firing chamber 100 (see FIGS. 13–14).

As the carrier assembly is guided along the track 90, the crank pin 58 extending from the bottom of the bolt locking mechanism 50 is guided toward the firing position by a generally axial groove that is illustrated as a cam groove 110. Once the crank pin 58 of the bolt locking mechanism 50 reaches a laterally displaced portion of the cam groove 112 (see FIG. 10), movement of the crank pin 58 through the displaced portion 112 causes the bolt locking mechanism 50, and particularly its elongated shaft 52, to rotate such that the groove 54 in the shaft 52 faces inwardly, unlocking the bolt 10 from the carrier 1 and allowing translation of the bolt relative to the carrier.

Once the bolt 10 can translate relative to the carrier 1 and the breech bolt contacts the aft face of the barrel chamber, the cam shaft 20, which is guiding the carrier assembly, is driven forward through the camming groove 18 in the bolt 10, bringing the carrier 1 forward along the bolt 10. When the carrier 1 slides forward along the bolt 10, it pulls the insulator/bolt assembly pin 32 forward through groove 30 in the bolt 10. Due to the curvature of the bolt grooves 18 and 30, as the cam shaft 20 and insulator/bolt assembly pin 32 move forward through their respective grooves, the bolt 10 is forced to rotate relative to the carrier 1. Due to proper placement of the displaced portion 112 of the groove 110, this rotation occurs after the bolt face 12 has been inserted into the chamber 100, and serves to rotate the bolt 10 so that the locking lugs 14 of the bolt face 12 engage the locking lugs 102 of the chamber 100 (see FIGS. 12 and 13).

Once the bolt face 12 has been locked in the chamber 100, the cocking pin 26 is released from its cocked position. Because the firing pin 60 is biased in a forward direction by the coil spring 80, it immediately slides forward in the rectangular slot 29 of the insulator 28 to its firing position (see FIG. 12). As the firing pin 60 moves to its firing position, it protrudes forward through a firing aperture 17 in the bolt face 12 (see FIGS. 3 and 5) until the firing pin 60 detonates the percussion primer of the cartridge (not shown). If fire volts are applied through the cocking pin 26, an electrical primer will detonate.

After the cartridge is fired, the carrier assembly is retracted toward its rear dwell position, ejecting the spent cartridge. The cam path for the cam shaft 20 and roller 22 guides them backward such that the cam shaft 20 and therefore the insulator/bolt assembly pin 32 slide through their respective grooves 18, 30, in the bolt 10 until the bolt 10 is in an extended position relative to the carrier 1. The shape of bolt grooves 18 and 30 causes the bolt head 12 to rotate so that locking lugs 14 of the bolt face 12 disengage the locking lugs 102 of the chamber 100. As the carriage assembly slides back along the track, crank pin 58 of the bolt locking mechanism 50 is guided by the cam groove 110 such that when the crank pin 58 of the bolt locking mechanism 50 slides through the groove 110 of the cam groove, it rotates the bolt locking mechanism 50, and particularly its shaft 52, to lock the bolt in its extended position within the carrier 1 before the bolt has completely retracted from the barrel.

Other embodiments of the invention will be apparent to those skilled in the art from consideration of the specification and practice of the invention disclosed herein. For example, the present invention also contemplates other methods for guiding the bolt locking mechanism such as, for example, a rib that extends from the rotor along which the bolt locking mechanism slides. It is intended that the specification and examples be considered as exemplary only, with a true scope and spirit of the invention being indicated by the following claims.

What is claimed is:

1. A carrier assembly for a gun, the assembly comprising a gun bolt carrier disposed to reciprocate axially with respect to the central axis of the gun, and a gun bolt disposed to reciprocate axially within the carrier, the bolt having a locking groove therein, the assembly comprising:

a bolt locking mechanism extending through a portion of the bolt carrier to selectively engage the locking groove and thereby prevent the bolt from moving with respect to the carrier; and a generally axial groove in a non-reciprocating portion of the gun that engages and selectively rotates the bolt locking mechanism to selectively lock the bolt to the carrier.

2. The carrier assembly of claim 1, the locking grove being transverse to the longitudinal axis of the bolt, said bolt locking mechanism preventing rotation and axial movement of said bolt with respect to the said carrier.

3. The carrier assembly of claim 2, the locking groove being on the surface of the bolt.

4. The carrier assembly of claim 1, wherein the bolt locking mechanism comprises an elongated shaft.

5. The carrier assembly of claim 4, wherein the elongated shaft includes a bolt passage grove having a shape that allows the bolt to pass through the bolt passage grove.

6. The carrier assembly of claim 1, wherein the bolt is cylindrical, said locking groove in said bolt being cylindrical and said bolt passage groove is semi circular with a radius substantially equal to the radius of the cylindrical bolt.

7. The carrier assembly of claim 1, wherein the bolt locking mechanism includes a crank on one end thereof, the crank including a crank pin, with the crank pin disposed to engage the axial grove in the non-reciprocating portion of the gun, the crank pin selectively rotating the bolt locking mechanism to selectively lock the bolt to the carrier.

8. The carrier assembly of claim 1, the axial groove in the non-reciprocating portion of the gun being displaced from the longitudinal axis of the bolt such that a crank pin engaging the axial grove is selectively rotated to selectively lock the bolt to the carrier when the carrier moves axially with respect to the non-reciprocating portion of the gun.

9. The carrier assembly of claim 6, wherein the bolt locking mechanism includes a portion that engages the bolt carrier to prevent axial movement of the bolt locking mechanism.

10. The carrier assembly of claim 6, wherein the bolt locking mechanism includes a flange, the flange engaging a portion of the carrier to prevent axial movement of the bolt locking mechanism.

11. The carrier assembly of claim 10, wherein the flange comprises a radical segment of a circle.

12. The carrier assembly of claim 11, wherein the portion of the bolt carrier comprises a circular groove in the bolt carrier, the circular engaging the flange to prevent axial movement of the bolt locking mechanism.

13. The carrier assembly of claim 12, wherein the circular grove in the bolt carrier comprises at radial segment of a circle.

14. A machine gun having a power having a power driven rotor including a carrier assembly that reciprocate along the longitudinal axis of the rotor, the carrier assembly including a bolt carrier having a gun holt reciprocally mounted therein, the gun bolt including a locking groove, the carrier assembly also including a bolt locking mechanism for selectively locking the bolt to the carrier assembly also including a bolt locking mechanism for selectively locking the bolt to the carrier such that the machine gun is capable of firing both electric and percussion primed ammunition, the bolt locking mechanism comprising:

a selectively rotatable locking member extending through a portion of the bolt carrier to selectively engage the locking groove and thereby prevent the bolt from moving with respect to the carrier;

wherein the carrier assembly includes an axial groove in a non-reciprocating portion of the gun that engages and selectively rotates the selectively rotatable locking member to selectively lock the bolt to the carrier.

15. The machine gun of claim 14, the locking grove being transverse to the longitudinal axis of the bolt, said bolt locking mechanism preventing rotation and axial movement of said bolt with respect to said carrier.

16. The machine gun of claim 15, the locking groove being on a surface of the bolt.

17. The machine gun of claim 14, wherein the selectively rotatable locking member includes a bolt passage groove having a shape that allows the bolt to pass through the bolt passage groove.

18. The machine gun of claim 17, wherein the bolt is cylindrical and the locking groove of the selectively rotatable locking member is semi-circular, having a radius substantially equal to the radius of the cylindrical bolt.

19. The machine gun of claim 14, wherein the selectively rotatable locking member comprises an elongated shaft.

20. The machine gun of claim 19, wherein the bolt locking mechanism includes a crank on one end of the selectively rotatable locking member, the crank including a crank pin, with the crank pin disposed to engage the groove in the non-reciprocating portion of the gun, the crank pin selectively rotating the selectively rotatable locking member to selectively lock the bolt to the carrier.

21. The machine gun of claim 20, the axial groove in the non-reciprocating portion of the gun being displaced circumferentially about the longitudinal axis of the bolt such that the crank pin engaging the groove is selectively rotated to selectively lock the bolt to the carrier when the bolt carrier moves axially with respect to the non-reciprocating portion of the gun.

22. The machine gun of claim 14, wherein the bolt locking mechanism includes a portion that engages the bolt carrier to prevent axial moment of the bolt locking mechanism.

23. The machine gun of claim 22, wherein the bolt locking mechanism includes a flange, the flange engaging a portion of the bolt carrier to prevent axial movement of the bolt locking mechanism.

24. The machine gun of claim 23, wherein the flange comprises a radial segment of a circle.

25. The machine gun of claim 23, wherein the portion of the bolt carrier comprises a circular groove in the bolt carrier, the circular grove engaging the flange to prevent axial movement of the bolt locking mechanism.

26. The machine gun of claim 25, wherein the circular groove in the bolt carrier comprises a radial segment of a circle.

27. The machine gun of claim 14, wherein said gun is capable of firing both percussion and electrical primers, said gun includes firing pins for firing the percussion and electrical primers, said firing pins each having a tip, a frusto-conical surface adjacent said tip, and an electrical insulator affixed over said frusto-conical surface.

28. The machine gun of claim 27, wherein said electrical insulator comprises a polymer material.

29. The machine gun of claim 27, wherein said electrical insulator comprises a resilient polymer material detachably affixed over said frusto-conical surface.

* * * * *